US007988117B2

(12) United States Patent
Blanchard

(10) Patent No.: US 7,988,117 B2
(45) Date of Patent: Aug. 2, 2011

(54) CONTAINER HOLDER

(76) Inventor: Normand Blanchard, Gatineau (CA)

( * ) Notice: Subject to any disclaimer, the term of this patent is extended or adjusted under 35 U.S.C. 154(b) by 0 days.

(21) Appl. No.: 12/585,255

(22) Filed: Sep. 10, 2009

(65) Prior Publication Data

US 2010/0059645 A1 Mar. 11, 2010

Related U.S. Application Data

(60) Provisional application No. 61/136,522, filed on Sep. 11, 2008.

(51) Int. Cl.
*A47G 1/10* (2006.01)

(52) U.S. Cl. ..... 248/316.4; 248/905

(58) Field of Classification Search ..... 248/309.1, 248/316.4, 316.8, 905, 229.12, 229.22, 231.41; 224/277, 539

See application file for complete search history.

(56) References Cited

U.S. PATENT DOCUMENTS

| | | | | |
|---|---|---|---|---|
| 1,750,576 | A * | 3/1930 | Cubberley | 211/11 |
| 2,263,956 | A * | 11/1941 | Russell | 248/311.2 |
| 2,991,036 | A * | 7/1961 | Russell et al. | 248/206.5 |
| 5,145,139 | A * | 9/1992 | Holtsch | 248/313 |
| 5,183,163 | A * | 2/1993 | Slaiken | 211/43 |
| 5,197,705 | A * | 3/1993 | Baskas | 248/316.7 |
| 6,170,725 | B1 * | 1/2001 | Ganues | 224/539 |
| 7,185,865 | B1 * | 3/2007 | Patrick | 248/318 |

* cited by examiner

*Primary Examiner* — Ramon O Ramirez
(74) *Attorney, Agent, or Firm* — George A. Seaby

(57) ABSTRACT

A holder for a container such as a tissue box includes a lower jaw for mounting on a wall or other vertical surface, and an upper jaw telescopically slidable in the lower jaw. The jaws include opposed, outwardly extending ledges for clamping a container therebetween. Meshing teeth on the jaws permit releasable locking of the jaws in a container clamping position.

17 Claims, 4 Drawing Sheets

CONTAINER HOLDER

This application claims priority on U.S. Provisional Patent Application 61/136,522 filed Sep. 11, 2008.

BACKGROUND OF THE INVENTION

Field of the Invention

This invention relates to a container holder, and in particular to a holder for a rectangular parallelepipedic container such as a tissue box.

While the holder of the present invention was initially designed to hold a tissue container on a vertical surface such as a wall, it will be appreciated that the holder can be used to hold other containers. For example, the holder could be used to hold a wide variety of dispensing containers such as a plastic glove carton.

BRIEF SUMMARY OF THE INVENTION

In general terms, the container holder of the present invention includes a lower jaw which is securely mounted on a vertical surface such as a wall and an upper jaw which is slidable in the lower jaw. The jaws include opposed, outwardly extending ledges for clamping a container therebetween. Opposed teeth on the jaws releasably retain the jaws in a container retaining or clamping position.

More specifically, the invention relates to a container holder comprising: a lower jaw including a vertical bottom back plate for mounting the holder on a vertical surface, and a bottom ledge extending outwardly from said bottom back plate for supporting a bottom of the container; an upper jaw including a vertical top back plate, and a top ledge extending outwardly from said top back plate for bearing against a top of the container; a recess in one of said jaws for receiving the other of said jaws, whereby the jaws can be slid relative to each other for sandwiching the container between said bottom and top ledges; and a rack including meshing teeth on sides of said back plates for releasably retaining the jaws in container clamping positions.

BRIEF DESCRIPTION OF THE DRAWINGS

The holder is described in greater detail with reference to the accompanying drawings, wherein.

DETAILED DESCRIPTION OF THE INVENTION

Figure 1:
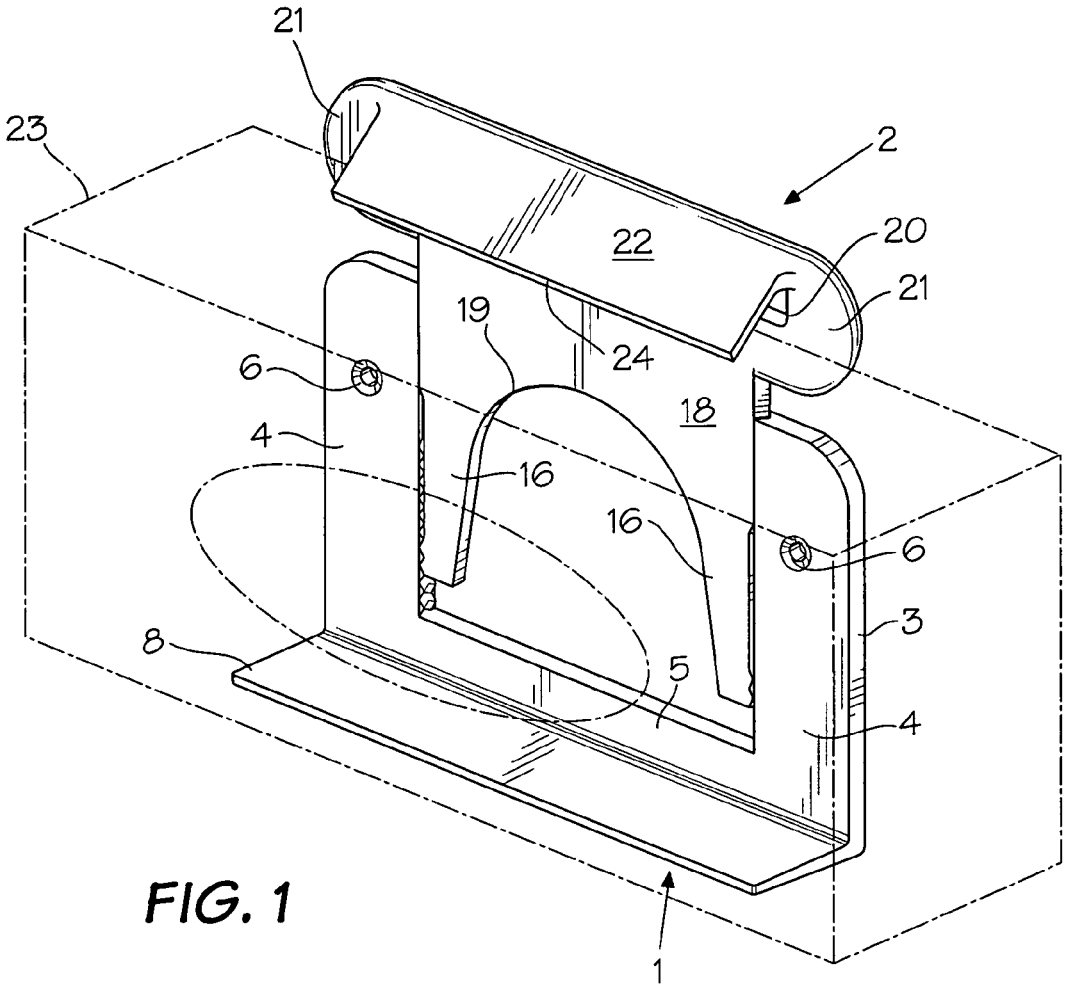
FIG. 1 is an isometric view of a container holder in accordance with the present invention.
Figure 2:
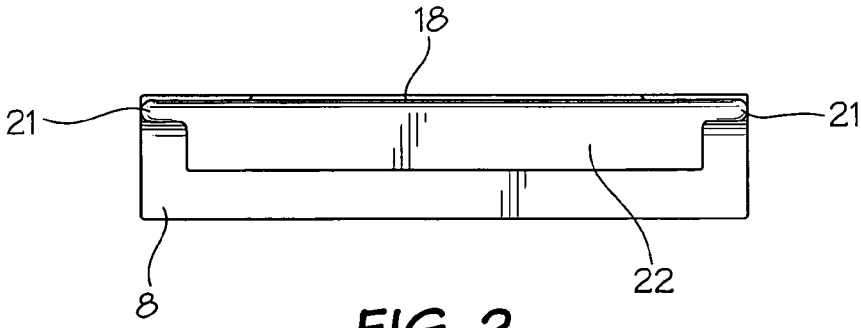
FIG. 2 is a top view of the container holder of FIG. 1.
Figure 3:
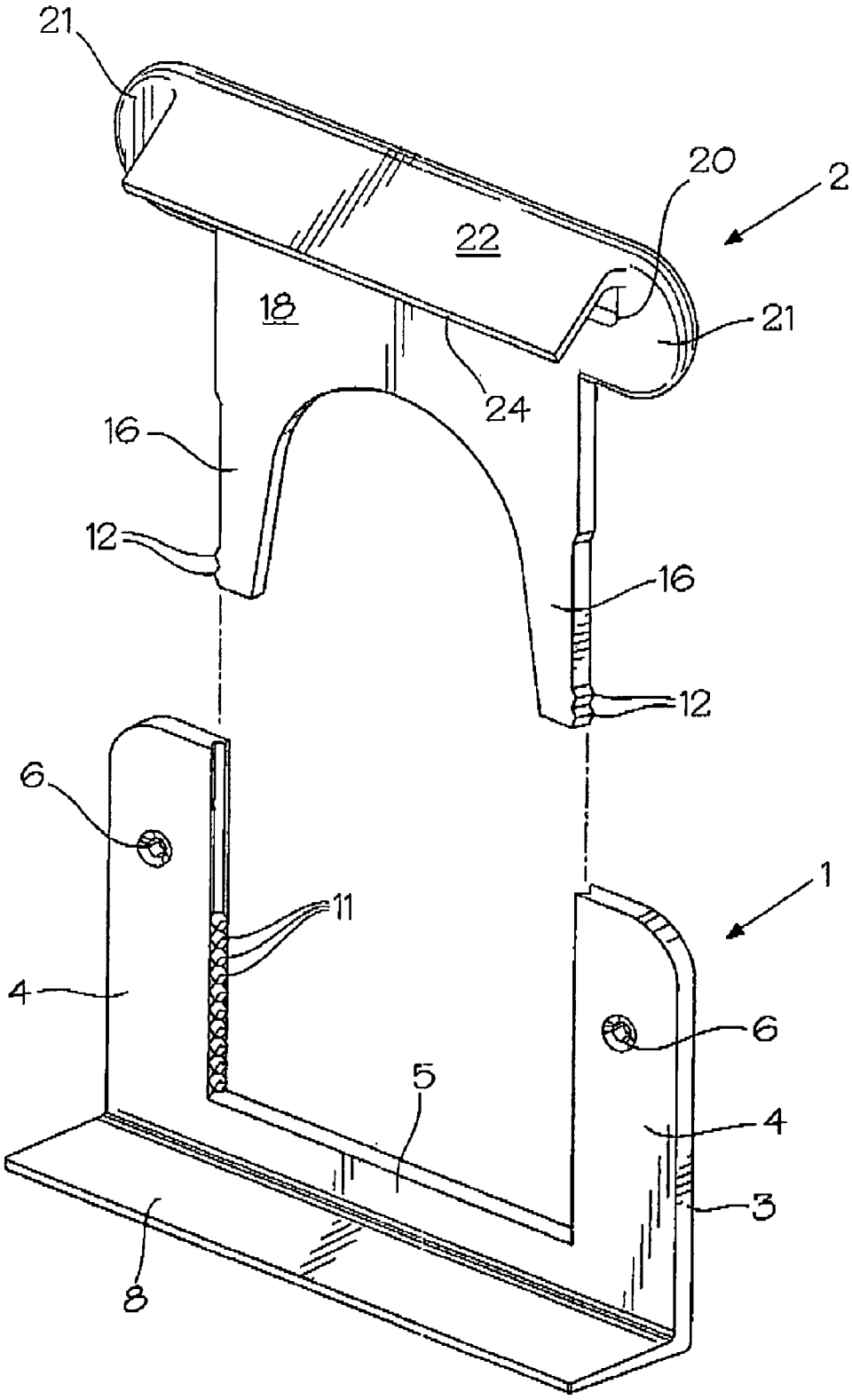
FIG. 3 is an exploded, isometric view of the container holder of FIGS. 1 and 2.

With reference to FIGS. 1 to 5, the basic elements of a first embodiment of the container holder include a lower jaw 1 and an upper jaw 2 slidable in the lower jaw 1.

The lower jaw 1 includes a generally U-shaped back plate 3 defined by a pair of sides or arms 4 interconnected at their bottom ends by a crossbar 5. Countersunk holes 6 near the top ends of the arms 4 receive screws (not shown) for mounting the jaw 1 on a wall or other vertical surface. A rectangular ledge 8 extends outwardly and preferably slightly upwardly from the bottom edge of the crossbar 5. The angle between the back plate 3 and the ledge 8 is 86-90° and preferably 88°. Reinforcing ribs 9 (FIG. 5) extend between the front the rear edges of the bottom of the ledge 8 to strengthen and limit flexing of the ledge. A2

Figure 6:
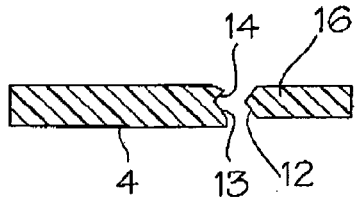
FIG. 6 is a cross-section taken generally along line 6-6 of FIG. 5.
Figure 5:
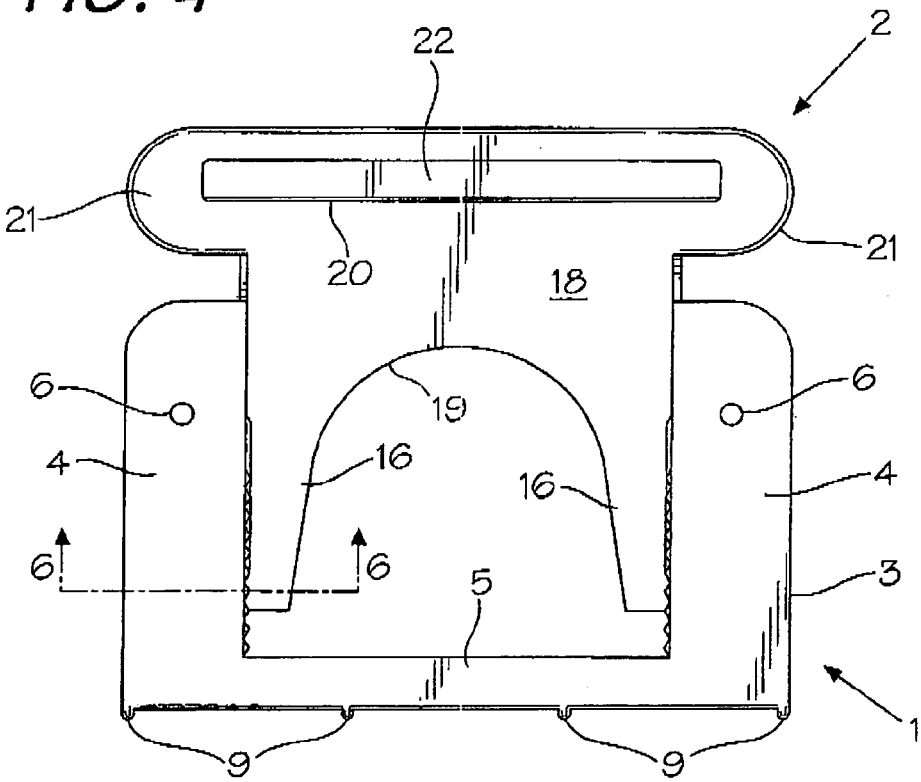
FIG. 5 is a rear view of the container holder of FIGS. 1-4.

A rack defined by a plurality of teeth 11 is provided on the inside edge of each side 4 for engaging teeth 12 on the bottom outside edges of the upper jaw 2. Each tooth 11 is triangular when viewed from the front or the rear. As best shown in FIG. 6, the outer free edge of each tooth 11 contains a generally V-shaped notch with the outer arm 13 of the V being longer than the inner arm 14 thereof. The outer free edge of each of the teeth 12 on the upper jaw 2 has an outwardly extending complementary V-shaped configuration when viewed from above, i.e. includes a V-shaped projection. Moreover, at least the rear surfaces of the teeth 12 are spaced slightly inwardly from the rear surfaces of the sides 4 and the resilient arms 16 carrying the teeth 12 on the upper jaws 2 are thinner than the sides 4. The purpose of this arrangement is to avoid frictional contact between the upper jaw 2 and a vertical surface carrying the holder, making sliding of the upper jaw 2 relative to the lower jaw substantially easier than if there was full contact between the jaw 2 and the vertical surface.

Figure 4:
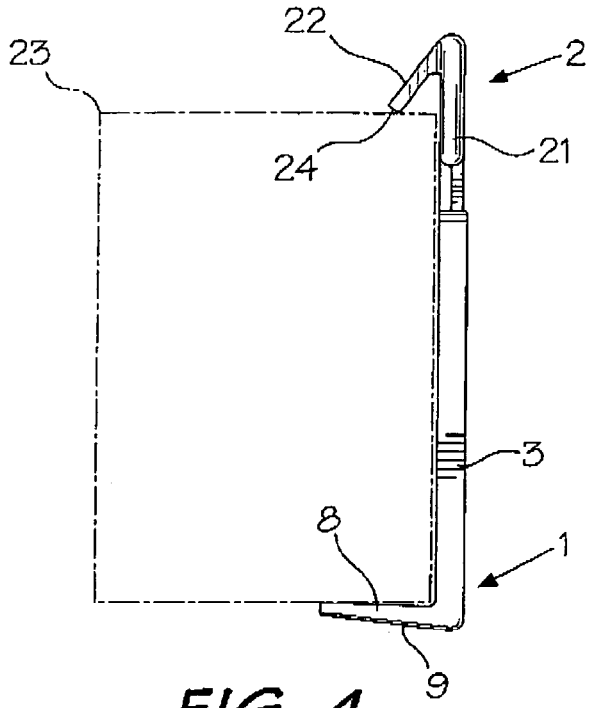
FIG. 4 is a side view of the container holder of FIGS. 1-3.
Figure 7:
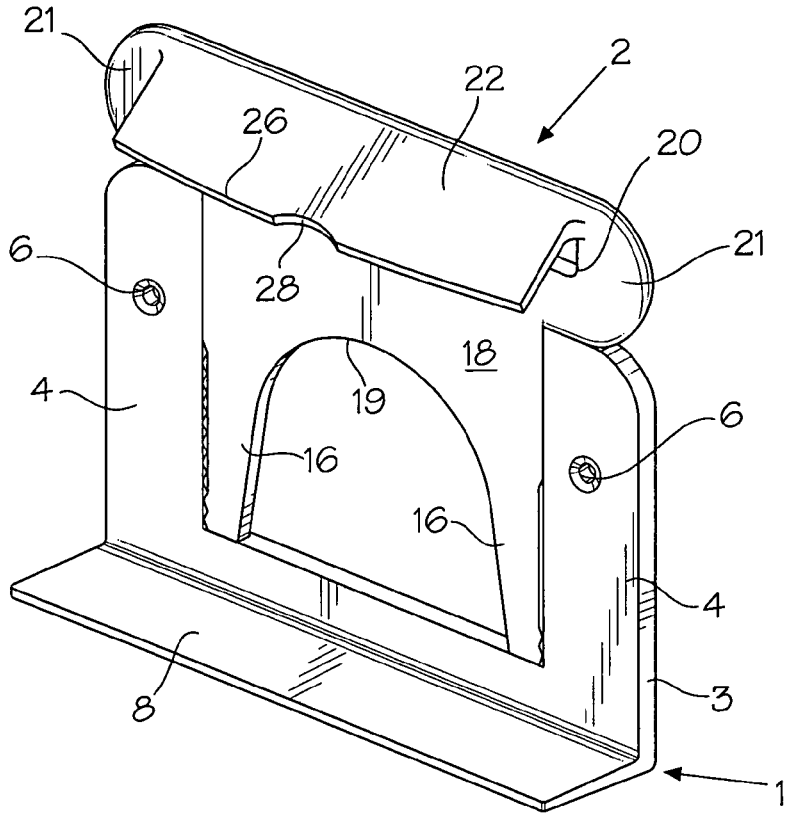
FIG. 7 is an isometric view of a second embodiment of the container holder.
Figure 8:
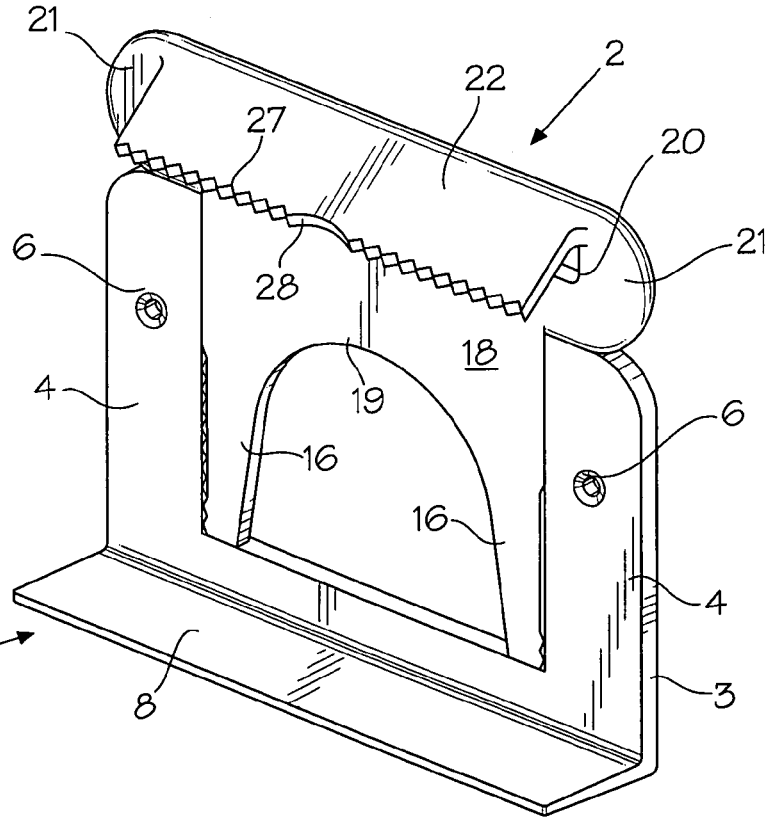
FIG. 8 is an isometric view of a third embodiment of the container holder.

The upper jaw 2 includes a generally T-shaped back plate 18 with an inverted U-shaped recess 19 in the stem of the T between the arms 16. The back plate 18 is thinner than the back plate 5 of the lower jaw 1. The arms 16 are slightly resilient so that they can flex slightly when the teeth 12 engage the teeth 9 which permit vertical movement of the upper jaw 2 relative to the lower jaw 1 even when the teeth 9 and 12 are meshing. A rectangular opening 20 in the top of the back plate 18 facilitates manual manipulation of the upper jaw 2 when assembling the holder. When the upper jaw 2 is slid fully into the lower jaw 1, wings 21 on the top of the back plate 18 engage the top ends of the arms 4 of the lower jaw limiting movement of the upper jaw into the lower jaw. A rectangular ledge 22 extends outwardly and downwardly from the top edge of the upper jaw 2 for engaging the top surface of a container 23 such as a tissue box (FIGS. 1 and 4). While the bottom, outer free edge 24 of the ledge 22 can be straight (as shown in FIGS. 1 to 4), the ledge can have a convex outer edge 26 (FIG. 7) or a serrated (sawtooth) outer edge 27, for gripping the container 23 (FIG. 8). Moreover, a concave groove 28 (FIGS. 7 and 8) can be provided in the free edge 24, 26 or 27 to facilitate gripping of the ledge 22 with a thumb or a finger.

As mentioned above, the container holder is mounted on a vertical surface such as a wall using screws which are inserted through the holes 6 in the backplate 3 of the lower jaw 1. The backplate 18 of the upper jaw 2 is then slid downwardly between the arms 4 of the lower jaw 1. A container 23 is placed between the ledges 8 and 22 of the lower and upper jaws 1 and 2, respectively. The upper jaw 2 is pushed downwardly until the outer, free edge 24 of the ledge 22 presses against the top of the container 23. In the container retaining position of the upper jaw 2, the teeth 12 on the upper jaw 2 meshes the teeth 9 on the lower jaw 1. As mentioned above, the arms 16 of the upper jaw 2 are slightly resilient permitting vertical movement up of the upper jaw when the teeth 9 and 12 are meshing. In order to remove the container 23 from the holder, it is merely necessary to pull the upper jaw 2 upwardly out of the lower jaw 1.

The invention claimed is:

1. A container holder comprising:

a lower jaw including a vertical, U-shaped bottom back plate for mounting the holder on a vertical surface, and a bottom ledge extending outwardly from said bottom back plate for supporting the bottom of a container;

said bottom back plate including a first pair of vertical arms defining sides of a recess, and a plurality of first teeth on inner edges of said arms;

an upper jaw including a vertical top back plate, and a top ledge extending outwardly from said top back plate for bearing against a top of the container, said back plate being slidable in said recess whereby the jaws can be slid relative to each other for sandwiching the container between said bottom and top ledges; and second teeth on outer edges of said top back plate for meshing with said first teeth for releasably locking the jaws in a container clamping position.

2. The container holder of claim 1, wherein said bottom ledge is perpendicular to a bottom edge of said lower jaw, and said top ledge is inclined downwardly from a top edge of said upper jaw.

3. The container holder of claim 1, wherein said bottom ledge is inclined upwardly and outwardly from a bottom edge of said lower jaw, and said top ledge is inclined downwardly from a top edge of said upper jaw.

4. The container holder of claim 1, wherein said top back plate includes a lower recess in the bottom thereof, whereby bottom outer edges of the plate are resilient for facilitating sliding of the jaws relative to each other.

5. The container holder of claim 1 including wings extending outwardly from the top end of said upper jaw for limiting movement of said bottom and top ledges towards each other.

6. The container holder of claim 5, wherein said top ledge includes an outer free edge, and a groove in said outer free edge for facilitating gripping of the upper jaw.

7. The container holder of claim 6, wherein said outer free edge of said top ledge is convex.

8. The container holder of claim 6, wherein said outer free edge of said top ledge is serrated for gripping the top of the container.

9. A holder for a rectangular parallelepipedic container comprising:

a lower jaw including a horizontal bottom ledge for supporting one side of the container, and a pair of parallel, spaced apart sides extending upwardly from said bottom ledge for mounting the holder on a vertical surface;

an upper jaw including a top ledge for bearing against a second side of the container opposite to said first side for retaining the container in the holder, and a pair of parallel, spaced apart resilient arms extending downwardly from said top ledge slidable between the sides of said lower jaw; and meshing teeth on inner edges of said sides of the lower jaw and on the outer side edges of said arms for releasably locking the upper jaw in a container clamping position in the lower jaw.

10. The container holder of claim 9 including wings extending laterally outwardly from a top end of said upper jaw for limiting movement of said upper jaw into said lower jaw.

11. The container holder of claim 10 including teeth on the lower half of said sides of the lower jaw and on the bottom ends of said arms of the upper jaw.

12. The container holder of claim 9, wherein the inner edge of said sides of the lower jaw and the teeth thereon include V-shaped notches, and the outer edges of said arms of the upper jaw and the teeth thereon include complementary V-shaped projections complementary to said notches.

13. The container holder of claim 9, wherein said upper jaw includes a horizontal top end integral with said top ledge and said arms, and an elongated opening in said top end facilitating manual manipulation of the upper jaw.

14. The container holder of claim 9, wherein said top ledge includes an outer free edge, and a groove in said outer free edge for facilitating gripping of the upper jaw.

15. The container holder of claim 14, wherein said outer free edge of said top ledge is convex.

16. The container holder of claim 14, wherein said outer free edge of said top ledge is serrated for gripping the second side of the container.

17. The container holder of claim 9, wherein the pair of arms of the upper jaw are thinner than the sides of the lower jaw for facilitating sliding of the upper jaw in the lower jaw.

* * * * *